United States Patent [19]

Riaboy

[11] 4,354,489

[45] Oct. 19, 1982

[54] INDIVIDUAL NOSE AND MOUTH FILTERS

[76] Inventor: Florence Riaboy, 4819 Sorrento Ct., Cape Coral, Fla. 33904

[21] Appl. No.: 198,767

[22] Filed: Oct. 20, 1980

Related U.S. Application Data

[63] Continuation-in-part of Ser. No. 30,520, Apr. 16, 1979, Pat. No. 4,240,420.

[51] Int. Cl.[3] ..... A62B 7/00

[52] U.S. Cl. ..... 128/206.14; 128/206.19; 55/511; 55/514; 55/DIG. 35

[58] Field of Search ..... 128/206.14, 206.25, 128/206.12, 206.19, 206.21, 206.28, 207.13, 207.11; 55/316, 387, 490, 501, 511, 524, DIG. 35, 514

[56] References Cited

U.S. PATENT DOCUMENTS

| | | | |
|---|---|---|---|
| 893,213 | 7/1908 | Whiteway | 128/206.16 |
| 2,928,388 | 3/1960 | Jaroslaw | 128/206.14 |
| 3,049,121 | 8/1962 | Brumfield et al. | 128/206.14 |
| 3,458,130 | 7/1969 | Juhlin | 55/511 |
| 4,004,584 | 1/1977 | Geaney | 128/206.14 |
| 4,240,420 | 12/1980 | Riaboy | 128/206.14 |

*Primary Examiner*—Henry J. Recla
*Attorney, Agent, or Firm*—Alfred E. Wilson

[57] ABSTRACT

Improved disposable nose and mouth filter masks are disclosed each of which is comprised of a sheet of a suitable air filtering material, sized and configurated for use in pairs to individually loosely cover the mouth and nostrils of the face of a wearer. A continuous peripheral adhesive strip is applied to peripheral edge areas of the filters with a removable backing strip being normally engaged on the inner exposed adhesive surface, the adhesive strips being applied in overlapping relation in the area between the nose and mouth of the user.

1 Claim, 4 Drawing Figures

INDIVIDUAL NOSE AND MOUTH FILTERS

This is a continuation in part of my copending application Ser. No. 030,520 filed Apr. 16, 1979, now U.S. Pat. No. 4,240,420.

BACKGROUND OF THE PRESENT INVENTION

The present invention pertains to nose and mouth filter masks utilizing pressure sensitive adhesive for attachment of the filter in a covering relation to the mouth and nostril areas of a person's face.

The filter material may be formed of any conventional commercially available tissue such as Kleenex, or similar material in one or more plies to filter solids from the air, or the filter material may be impregnated for example with activated charcoal or other suitable materials to filter out gaseous elements in addition to the solids.

Therefore, one of the principal objects of the present invention is to provide inexpensive filter units for use in pairs to cover the nose and mouth areas of a user.

Another object of the invention is to provide a pressure sensitive adhesive in a peripheral strip about the edge portion of each filter member with a removable peel off cover engaged on the normally exposed surface of the adhesive.

A further object of the invention is to provide a single filter configurated for use in a covering relation for the mouth and nostril areas of the user.

Yet another object of the invention is to provide mouth and nostril filters which are disposable and which are formed in a flattened condition for easy packaging.

DESCRIPTION OF A PREFERRED EMBODIMENT

Figure 1:
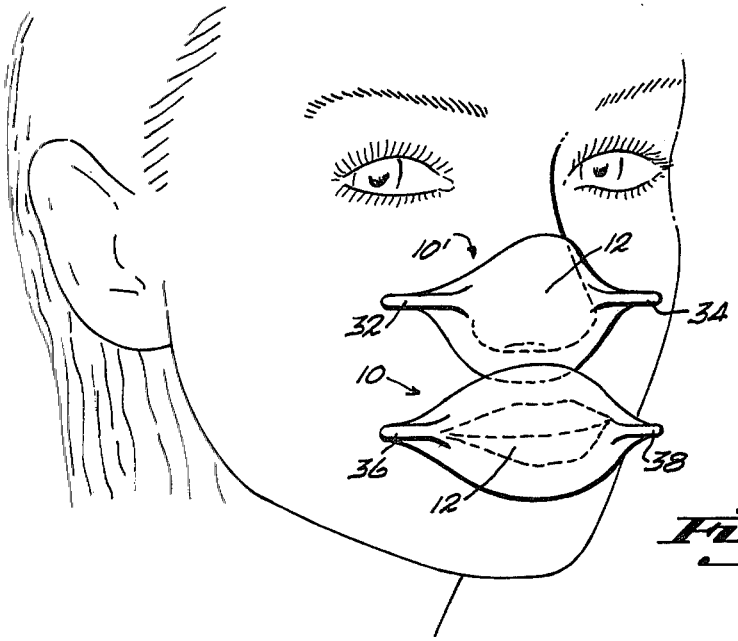
FIG. 1 is a front perspective view of a person's face illustrating a nose and mouth filter of the present invention adhesively secured in place.

With reference to the drawing and particularly to FIG. 1, filters 10 and 10' are illustrated in adhesive attachment about the mouth and nostril areas of a person's face. If desired the filters 10 and 10' can be substantial duplicates of each other to reduce the cost of manufacture and distribution. Each filter such as 10 is comprised of a central filter member 12 and a continuous peripheral band of a pressure sensitive adhesive 14, which in a preferred form may be composed of a continuous pressure sensitive adhesive tape 16 extending a predetermined distance inwardly from the peripheral edge of the filter member 12, which is adhesively secured to a first outer adhesive side 18 of tape 16, FIG. 3. If desired liquid adhesive sprayed or otherwise applied may be used.

Figure 2:
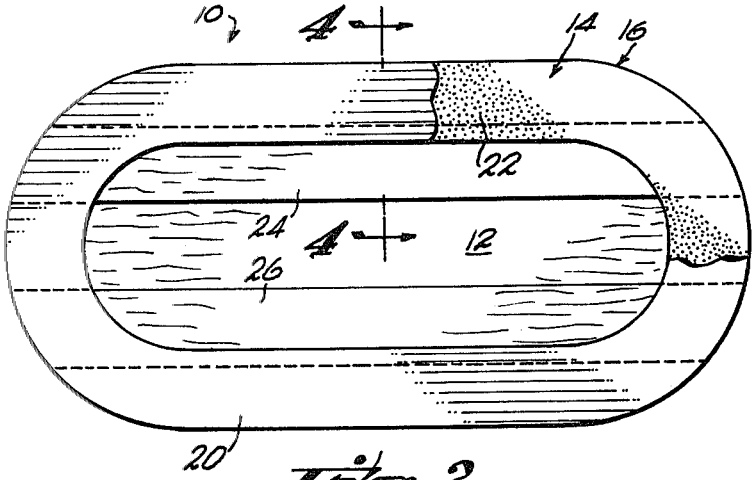
FIG. 2 is a plan view of the inner side of the filters of FIG. 1.

A protective peel off band 20 is normally secured to the second inner pressure sensitive adhesive side 22, FIG. 2. Strip 20 is continuously formed of a suitable material in a generally elongated oval or other configuration to conform generally with the size of the second, inner adhesive side 22.

Alternatively, the pressure sensitive adhesive 14 may be sprayed or otherwise applied to and about the outer peripheral edge portion of the filter member 12, with the peel off band 20 applied to the inner exposed adhesive surface 22.

Figure 4:
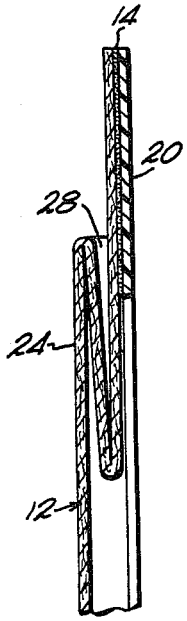
FIG. 4 is a substantially enlarged fragmentary sectional view taken along line 4—4 of FIG. 2.
Figure 3:
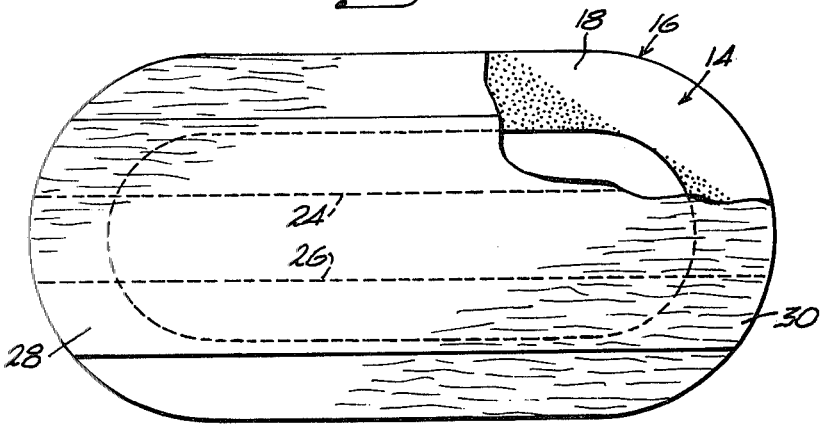
FIG. 3 is a plan view of the outer side of FIG. 2.

As illustrated in FIGS. 2, 3 and 4, the filter member 12 may if desired be longitudinally pleated at 24, 26 or it may be otherwise configured to provide a loose comfortable expansion thereof for engagement over the nose and mouth areas as illustrated in FIG. 1. Pleats 24, 26 are adhesively secured in a closed condition at their respective opposed ends 28, 30 to effect a seal when in use, as illustrated in FIGS. 3 and 4.

In use, a filter mask such as 10' is first engaged for example, over the nostril area by removing the protective band 20 and adhering the lower edge of the mask in the area between the bottom of the nostrils and above the upper lip. The upper edge may then be adhered across the lower nose bridge and onto the cheeks and the ends are pinched together as illustrated at 32, 34.

A second filter mask such as 10 is then placed over the mouth area by removing the band 20 and adhering the upper edge thereof just above the upper lip in the area beneath the nostrils, overlapping the bottom edge of filter mask 10'. The lower edge of 10 is then adhered below the lower lip and the ends are pinched together as illustrated at 36, 38.

While a preferred form of the instant invention is herein disclosed, it will be obvious to those skilled in the art that various modifications and changes can be made therein without departing from the true spirit of the invention as defined in the appended claims.

I claim:

1. An oronasal filter mask comprising two identical filter mask elements for use in pairs wherein one of said filter elements of the pair is adapted to cover the nostrils of a user and the other of said filter element is adapted to cover the mouth areas of a user, each filter mask element of said pair including a suitable centrally disposed flexible filter material the perimeter of which defines an outwardly extending peripheral flange and being generally ovoid in shape with rounded ends and wherein the dimension of the overall length is approximately twice the dimension of the overall width of each filter mask element, each filter mask element being sized and configurated to cover the mouth area of the user and thereby, also being sufficiently sized and configurated to cover the nostril area of the user, and a continuous band of a pressure sensitive adhesive material applied around said outwardly extending peripheral flange and outside of the centrally disposed flexible filter material for secure engagement with a predetermined facial skin area of the user, the pressure sensitive adhesive area of one of the filter mask elements overlying and being bonded to the pressure sensitive adhesive area of the other filter element in the area between the nostrils and mouth when said filter mask elements are applied to both the nostril and mouth areas.

* * * * *